United States Patent [19]

Ueno et al.

[11] 3,952,963

[45] Apr. 27, 1976

[54] CYLINDRICAL WINDING CORE FOR CARRYING A ROLL OF ELONGATED WINDABLE MATERIAL

[75] Inventors: Niro Ueno; Ippei Shiraishi, both of Tokyo, Japan

[73] Assignees: Mitsui Toatsu Chemicals, Incorporated; Topacs, Incorporation, both of Tokyo, Japan

[22] Filed: Oct. 4, 1974

[21] Appl. No.: 512,144

[52] U.S. Cl. ..... 242/68.5

[51] Int. Cl.[2] ..... B65H 17/02

[58] Field of Search ..... 242/68.5, 68.6, 159, 242/176, 177, 178, 179; 206/389, 411, 813

[56] References Cited

UNITED STATES PATENTS

| | | | |
|---|---|---|---|
| 972,667 | 10/1910 | Wheeler | 242/68.5 |
| 2,695,139 | 11/1954 | Horvath | 242/68.5 |
| 2,755,576 | 7/1956 | Golden | 206/813 |

*Primary Examiner*—Edward J. McCarthy
*Attorney, Agent, or Firm*—Lane, Aitken, Dunner & Ziems

[57] ABSTRACT

A cylindrical winding core for carrying a roll of elongated flexible material, the core having an anti-slack flexible member and being capable of adapting to rolls of different inner diameters. The core can be advantageously used for preventing a roll of paper strip or tape such as paper punch tapes used in electronic computers from slackening.

9 Claims, 4 Drawing Figures

CYLINDRICAL WINDING CORE FOR CARRYING A ROLL OF ELONGATED WINDABLE MATERIAL

BACKGROUND OF THE INVENTION

Field of the Invention

This invention relates to a winding core for supporting thereon a roll of elongated windable material such as thread, cord, tape or the like, and more particularly to a core structure particularly suitable for winding a paper punch tape used with an electronic computer.

Elongated strips, cords and tapes of paper, cloth or synthetic resin are widely used in various fields for diversified purposes, for example, in the packaging and data processing industries. These strips and tapes are usually provided in the form of a roll but are easily loosened by rough or inadvertent handling, lowering their working efficiency to a considerable degree.

The paper punch tapes for electronic computers on the market generally have a length of 270 meters and a width of 1 inch and are tightly wound around a paper board core of a cylindrical shape. However, it is rare that such a paper board core of cylindrical shape is used when wholly or partially punched paper tape is wound. Usually, clips, rubber bands or other means are applied to the outer surface of the rewound punched tape which has been at least once unwound for punching, in order to prevent the punched tape from unravelling. But the innermost end of rerolled punched tape is usually left free. Cores for rerolling punched paper tape are not available on the market. The reason why such cores are not available on the market is that the winding reels exist in different diameters.

Even if a user were to make a suitable cylindrical core for rewinding, he would find it tedious to attach one end of the punched tape to the core. In addition, the pasted part of the punched tape would disturb in the reading of the last part of the tape by a computer. In handling rolled paper tapes which have been already punched, operators are usually required to pay special attention not to dislodge the rolls from their winding cores since, once a portion of the rolled tape is dislodged, the roll has to be completely disentangled and rewound. The rewinding operation is often time-consuming because the rolled tapes are twisted at every turn and the twisted tapes have to be straightened during the re-winding operation, the tapes being broken in some cases. The tendency of the wound tapes to unravel is increased as they are used with greater frequency. Spontaneous unravelling of the rolled tapes sometimes occurs even during storage.

SUMMARY OF THE INVENTION

The present invention provides a winding core for carrying thereon a roll of elongated material such as a tape or cord, the core having a cylindrical body formed by flexing a strip of resilient material and connecting one end of the strip to a portion of the strip short of the other end. The strip forming the body of the winding core may be a sheet of a synthetic resin, wood or metal but should have suitable flexibility. If desired, a color or a decorative pattern may be applied to the surface of the flexible sheet material to increase its commercial value. When flexing the sheet material into a cylindrical form, one end of the sheet is left free to extend as a free convolute portion, tangential to the cylindrical body and for a suitable length depending upon the nature of the material which is to be wound around the core. Due to the restoring force of the flexed resilient sheet, the free end of the core within the center opening of the rolled tape tends to push the rolled tape from inside in a radially outward direction so that each wind of the rolled tape is held in contact with the surfaces of overlying and underlying winds with sufficient contact pressure. Thus the free inner end of the core strip acts as a spring to bias the flexible core material against the wound paper tape thereby securing the core to the tape and taking up slack during winding. Even if the outer diameter of the winding core is slightly smaller than the inner diameter of the center opening of the rolled tape, the core can still perform the slack preventing function as long as the restoring force of the flexed core is transmitted to the rolled tape. Obviously, the winding core can easily be formed from the strip and no particular skill is required for assembly. One end of the rolled flexible sheet is connected to a sheet portion of the strip spaced from the other end by a suitable distance, by means of an adhesive, metallic connecting means such as a stapler pin or by heat adhesion, sewing or welding.

The above and other objects, features and advantages of the present invention will become clear from the following description and appended claims, taken in conjunction with the accompanying drawings which form a part of this specification and which show a preferred embodiment of the present invention.

DETAILED DESCRIPTION OF THE INVENTION

Figure 1:
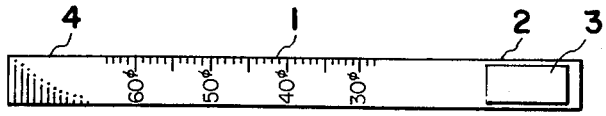
FIG. 1 is a plan view showing a resilient strip employed in the present invention.
Figure 2:
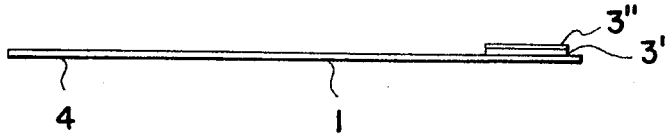
FIG. 2 is a side view of the strip of FIG. 1.

Referring to FIG. 1 of the accompanying drawing, the tape or strip which forms the winding core of the invention is a generally rectangular sheet of resilient material 1. The sheet material 1 has securely mounted at one end 2 of the strip a double faced adhesive tape 3. The adhesive tape 3 may be mounted at a digital end of the sheet 1 or in a position which is spaced from the digital end by a suitable distance. One of the two adhesive surfaces of the double faced adhesive tape 3' is securely adhered to the sheet 1 while the other adhesive surface is covered with a non-adhesive sheet 3'' which is to be peeled off to form the winding core as will be described hereinlater.

Figure 3:
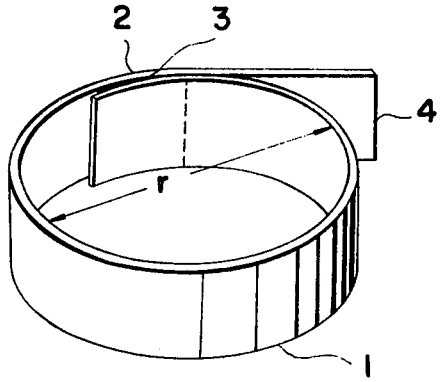
FIG. 3 is a perspective view showing the strip of the present invention rolled into a cylindrical shape to serve as a winding core.
Figure 4:
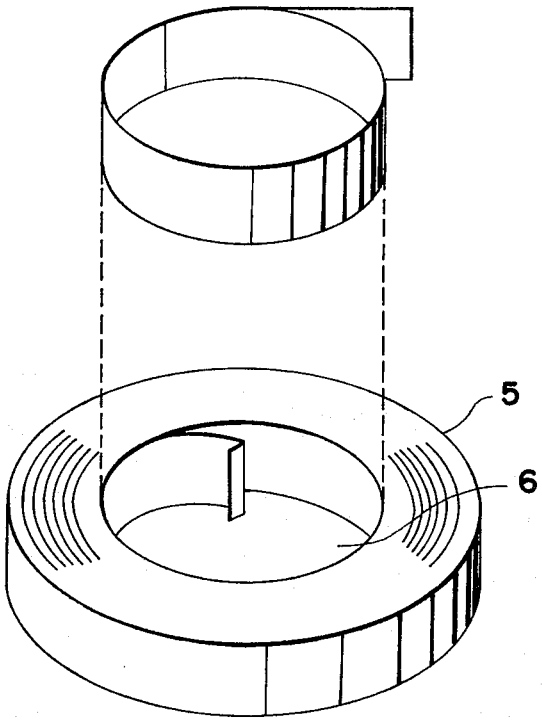
FIG. 4 is a perspective view showing the manner for inserting the winding core of the invention into the center opening of a rolled tape.

The resilient sheet or strip 1 is rolled into a cylindrical shape as shown in FIG. 3. The cylindrical core body thus formed by the sheet 1 has a radius *r* which is determined according to the diameter of the center opening of the tape to be wound around the core 1. The end of the rolled sheet 1 which has the double faced adhesive tape strip 3 is, after peeling off the non-adhesive cover 3'', secured to an opposing facing sheet portion which is spaced from the outermost edge of end portion 4 by a suitable distance to leave the portion of the strip between such point of securement and the end 4 extending essentially on a tangent to the cylindrical body as a free convolute portion. The strip 1 can be conveniently rolled into a cylinder of a predetermined radius *r* by providing graduations in length units multiplied by a circular constant longitudinally on the surface of the strip. The cylindrical core 1 thus formed is inserted into the center opening of a tape roll as depicted in FIG. 4. Since the strip 1 is formed from a flexible resilient material as previously mentioned, the cylinder can be deformed into a shape which will facilitate insertion into the center opening 6 of the rolled material 5. Where the diameter of the center opening of the rolled material 5 is standard, the core may be provided as a preformed cylinder with one end of the sheet permanently connected at a point spaced from the other end by a suitable distance by connecting means other than the double faced adhesive tape 3.

It will be appreciated from the foregoing description that, with the winding core of the invention, slack in a rolled material such as a roll of cord or tape can be completely prevented. As a result of the tangential free convolute portion being stressed by the wound elongated material in a manner to exert an outward bias against the wound material. The elongated material may be directly wound around the core of the invention, or, if desired, may be prewound on a separate reel or bobbin and then transferred onto the winding core of the invention. The slackening of wound paper rolls in storage can also be prevented by use of these flexible winding cores.

The winding strip or core 1 is formed, for example, from a resilient sheet of a synthetic resin such as hard vinyl chloride, polypropylene, polystyrene, bakelite, polyethylene or the like having a thickness of about 0.2 mm to about 0.5 mm. It is also possible to use a wooden sheet material such as wood shavings, one-ply veneer or the the like. Alternatively, there may be employed a metal sheet of spring steel, phosphor bronze, mild steel, aluminum or the like having a thickness preferably less than 0.1 mm but greater than 0.01 mm. Since the winding core of the invention is normally provided in the form of a flat sheet, a great number of core sheets can be stored in a stacked state and in a small space.

The greater the length of the free end of the rolled winding core, the greater is the restoring force of the core. However, since the initial end of the wound material is usually hooked prior to a winding operation (FIG. 4), an excessively lengthy free end will deflect too much during the winding operation, releasing the paper tape.

As previously mentioned, the winding core of the present invention can suitably be used with rolled paper punch tapes for electronic computers for to prevent the punched tape rolls from unravelling. It is a common experience that, in case of repeated intermittent reading or punching inner winds of paper punch tape rolls loosen and allow a portion or portions of the rolled tapes to bulge out and frictionally contact the tape feed mechanism interfering with the smooth feed of the paper tapes and causing false input to the computer or mispunching.

What is claimed is:

1. A winding core for supporting thereon a wound length of an elongated material, said core having a cylindrical body formed by rolling a strip of resilient material into a cylindrical shape and securing one end of said resilient strip to a point spaced from the opposite end to leave the portion of said strip between said point of securement and said opposite end extending essentially on a tangent to said cylindrical body as a free convolute portion, whereby said convolute portion is stressed by the winding of elongated material about said core to provide an outward bias against the wound material.

2. The winding core of claim 1, wherein said one end of said flexible sheet is secured at said point with at least one double faced adhesive tape strip mounted on said flexible sheet.

3. The winding core of claim 1, wherein said elongated material is a paper punch tape for an electronic computer.

4. The winding core of claim 1, wherein said cylindrical core body is formed from a sheet of celluloid or a synthetic resin material selected from polyvinyl chloride, polypropylene, polystyrene, bakelite, and polyethylene and having a thickness from 0.2 mm to 0.5 mm.

5. The winding core of claim 1, wherein said cylindrical winding core is formed from a wooden material selected from wood shavings and one-ply veneer.

6. The winding core of claim 1, wherein said cylindrical winding core is formed from a sheet of metallic material selected from phosphor bronze, spring steel, mild steel and aluminum and having a thickness from 0.01 mm to 0.1 mm.

7. The winding core of claim 1, wherein said strip of flexible material is provided with graduations along its length, said graduations representing various radii.

8. A strip of a resilient material for forming a winding core for paper punch tape by rolling the strip into a cylindrical shape, said strip having a double faced adhesive tape with one face adhering to said strip adjacent one end thereof, the opposite face of said adhesive tape being covered with a non-adhesive sheet removable for securement of said opposite face to said strip after it is rolled into the cylindrical shape, and said strip being provided with graduations along its length to represent various radii of cylindrical shapes to be formed from said strip.

9. The strip of claim 8, wherein said flexible material is selected from polypropylene, polyvinyl chloride, polystyrene, bakelite and polyethylene.

* * * * *